US006587015B2

(12) United States Patent
Jinushi

(10) Patent No.: US 6,587,015 B2
(45) Date of Patent: Jul. 1, 2003

(54) TRANSMISSION/RECEPTION UNIT WITH IMPROVED ANTENNA GAIN

(75) Inventor: Satoru Jinushi, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/056,435

(22) Filed: Jan. 23, 2002

(65) Prior Publication Data

US 2002/0101298 A1 Aug. 1, 2002

(30) Foreign Application Priority Data

Jan. 30, 2001 (JP) ..... 2001-021520

(51) Int. Cl.[7] ..... H01P 1/213; H01Q 1/24
(52) U.S. Cl. ..... 333/132; 343/702; 343/846
(58) Field of Search ..... 333/132, 134; 343/700 MS, 702, 846

(56) References Cited

U.S. PATENT DOCUMENTS 5,864,265 A * 1/1999 Ballance et al. ..... 333/206
5,969,680 A * 10/1999 Tsuru et al. ..... 343/702
6,140,968 A * 10/2000 Kawahata et al. ..... 343/702
6,177,908 B1 * 1/2001 Kawahata et al. ..... 343/702
6,323,811 B1 * 11/2001 Tsubaki et al. ..... 343/702

FOREIGN PATENT DOCUMENTS

| | | |
|---|---|---|
| EP | 0902508 | 3/1999 |
| EP | 1096595 | 5/2001 |
| JP | 07-221822 | 8/1995 |
| JP | 11-274843 | 10/1999 |
| WO | WO 0052783 | 9/2000 |

* cited by examiner

*Primary Examiner*—Seungsook Ham
(74) *Attorney, Agent, or Firm*—Brinks Hofer Gilson & Lione

(57) ABSTRACT

In the transmission/reception unit according to the present invention, a first corner of a cover, which is located in the vicinity of transmission and reception terminals and a ground terminal of an antenna, or the vicinity of the corner, is soldered to a non-ground wiring pattern and an electrical length of the ground conductor from the ground terminal is increased. This ensures that even in a compact transmission/reception unit, the electrical length is equivalent to λ/4 and the antenna gain is improved; therefore, a transmission/reception unit with a satisfactory transmission/reception sensitivity can be realized.

9 Claims, 9 Drawing Sheets

TRANSMISSION/RECEPTION UNIT WITH IMPROVED ANTENNA GAIN

BACKGROUND OF THE INVENTION

1. Field of the Invention

The present invention relates to a transmission/reception unit suitable for use in a portable telephone, etc.

2. Description of Related Art

Referring to FIGS. 10 and 11, a conventional transmission/reception unit has a wiring pattern 52 and ground patterns 53*a* and 53*b* on a circuit board 51 constituting a printed circuit board, etc, where an antenna 54 as a conductor is formed on this circuit board 51.

The antenna 54 comprises a linear belt antenna element 55, and transmission and reception terminals 56 and 57 and a ground terminal 58 which are located on one end of the antenna element 55.

Various electric components (not shown) which make up transmission and reception circuitry are connected to the wiring pattern 52 on the circuit board 51, and the transmission and reception terminals 56 and 57 of the antenna 54 are connected through the wiring pattern 52 to the transmission and reception circuitry and the ground terminal 58 is grounded via the ground pattern 53*a*.

The ground patterns 53*a* and 53*b* are connected via a ground pattern (not shown) formed virtually on the whole lower surface of the circuit board 51, though not shown in these figures.

A hexahedral box type cover 59 is made of sheet metal. It has a square top wall 60, a first side wall 61, a second side wall 62, a third side wall 63 and a fourth side wall 64, a notch 61*a* made at the bottom of the first side wall 61, and four corners 65*a*, 65*b*, 65*c* and 65*d* (first, second, third and fourth corners, respectively), where the side walls are formed by bending down the four sides of the top wall 60, and the corners are defined by the side walls.

The cover 59 rests on the circuit board 51 in a way that it covers the electric components disposed on the circuit board 51 except the antenna 54, and the first, second, third and fourth side walls (61, 62, 63, 64) are fixed to the circuit board 51 by soldering their bottoms to the ground pattern 53*b*.

The position of the cover 59 on the circuit board 51 is determined by mounting legs (not shown) provided at the bottom of the first and third side walls 61 and 63 which are inserted into holes (not shown) in the circuit board 51. With the cover 59 in place, the antenna element 55 of the antenna 54 lies along the first side wall 61.

Also, with the cover 59 in place, the transmission and reception terminals 56 and 57 and the ground terminal 58 are located in the vicinity of the first corner 65*a*, and there is a notch 61*a* above the wiring pattern 52 connected with the transmission and reception terminals 56 and 57 of the antenna 54 and the ground pattern 53*a* so that the wiring pattern 52 and the ground pattern 53*a* are electrically isolated from the first side wall 61.

The ground pattern 53*a* connected with the ground terminal 58 of the antenna 54 is connected to the ground pattern 53*b* through the ground pattern provided on the rear face of the circuit board 51. The conventional transmission/reception unit is structured as mentioned above.

FIG. 11 illustrates the electrical length of the ground conductor connected with the ground terminal 58 of the antenna 54 in the conventional transmission/reception unit. As shown in the figure, the electrical length L of the ground conductor in the conventional unit is the sum of the following lengths: a length L31 of the ground pattern 53*a* between the ground terminal 58 and the ground pattern on the rear face of the circuit board 51; a length L32 of the ground pattern on the rear face of the circuit board 51 which lies in the area corresponding to the area between the ground pattern 53*a* and the first corner 65*a* of the cover 59; a length L33 as the distance from the bottom of the first or second side wall to its top; and a length L34 as the distance from the first corner 65*a* to the fourth corner 65*d* on the top wall 60.

Namely, the electrical length L of the conventional ground conductor is expressed by L31+L32+L33+L34. It is desirable that this electrical length L be equal to the length $\lambda/4$ of the antenna element 55 of the antenna 54. However, as demand for a more compact transmission/reception unit is growing, there is a tendency to reduce the size of the cover 59, resulting in a decrease in the lengths L31, L32, L33 and L34. As a consequence, the electrical length L tends to be shorter than the length $\lambda/4$.

Regarding the length $\lambda/4$ of the antenna element 55, as the frequency becomes lower, the wavelength becomes longer (i.e. $\lambda/4$ increases); however, in the conventional unit, a sufficient electrical length L could not be obtained at high frequencies and low frequencies.

When the antenna 54 is formed on the circuit board 51, if it has a linear antenna element 55 having the required length, the circuit board 51 must be large enough to accommodate it, so the circuit board 51 cannot be compact enough. In addition, the circuit board 51 is on the reverse of the side on which the antenna element 55 is exposed, resulting in a larger loss in radio wave radiation and radio wave reception at the antenna element 55.

Therefore, the problem of the conventional transmission/reception unit is summarized as follows: the electrical length L of the ground conductor connected with the ground terminal 58 of the antenna 54 (L31+L32+L33+L34) is shorter than $\lambda/4$; as the cover 59 becomes smaller, the electrical length L becomes shorter, namely its difference from the length $\lambda/4$ becomes larger, which leads to a decrease in the gain of the antenna 54 and thus a decrease in its transmission/reception sensitivity.

SUMMARY OF THE INVENTION

In view of the above circumstances, an object of the present invention is to provide a transmission/reception unit in which an electrical length of the ground conductor connected with the ground terminal of the antenna is sufficiently long and the antenna gain is improved.

As a first solution to the above problem, the invention provides a transmission/reception unit comprising:

a circuit board having a wiring pattern including various electric components;

a cubic or hexahedral box type cover made of sheet metal which is mounted in such a manner as to cover the electric components; and an antenna mounted on the circuit board, the cover having:

- a top wall;
- a first, a second, a third and a fourth side walls which are formed by bending four sides of the top wall;
- a first corner defined by the neighboring first and second side walls;
- a second corner defined by the first side wall and the neighboring third side wall;

a third corner defined by the second side wall and the neighboring fourth side wall; and a fourth corner defined by the neighboring third and fourth side walls, the antenna having:

an antenna element as a conductor laid along the first side wall of the cover; and transmission and reception terminals and a ground terminal which are provided in the vicinity of the first corner and located at one end of the antenna element, wherein the ground terminal is connected to a ground pattern provided on the circuit board, the first corner of the cover or its vicinity is soldered to the non-ground wiring pattern, and the ground pattern is connected with the second corner or its vicinity, or the third corner or its vicinity, or the fourth corner (located diagonally to the first corner) or its vicinity, or part of the third or fourth side wall.

As a second solution, the fourth corner or its vicinity is connected to the ground pattern, and an electrical length of the ground conductor connected to the ground terminal of the antenna consists of: a length of the ground pattern extending from the ground terminal to the fourth corner or its vicinity; a length as a distance from a point of connection with the ground pattern to a top of the third or fourth side wall; a length as a distance on the top wall between the first corner and the fourth corner; and a length as a distance from a top of the first or second side wall to its bottom.

As a third solution, the third corner or its vicinity is connected to the ground pattern, and an electrical length of the ground conductor connected to the ground terminal of the antenna consists of: a length of the ground pattern extending from the ground terminal to the third corner or its vicinity; a length as a distance from a point of connection with the ground pattern to a top of the second or fourth side wall; a length as a distance on the top wall between the second corner and the third corner; and a length as a distance from a top of the first or third side to its bottom.

As a fourth solution, the second corner or its vicinity is connected to the ground pattern, and an electrical length of the ground conductor connected to the ground terminal of the antenna consists of: a length of the ground pattern extending from the ground terminal to the second corner or its vicinity; a length as a distance from a point of connection with the ground pattern to a top of the first or third side wall; a length as a distance on the top wall between the second corner and the third corner; and a length as a distance from a top of the second or fourth side wall to its bottom.

As a fifth solution, part of the third side wall located between the second and fourth corners is connected to the ground pattern, and an electrical length of the ground conductor connected to the ground terminal of the antenna consists of: a length of the ground pattern extending from the ground terminal to part of the third side wall; a length as a distance from a point of connection with the ground pattern to a top of the third side wall; a length as a distance on the top wall from this point on a top to the first or third corner; and a length as a distance from a top of the first, second or fourth side wall to its bottom.

As a sixth solution, part of the fourth side wall located between the third and fourth corners is connected to the ground pattern, and an electrical length of the ground conductor connected to the ground terminal of the antenna consists of: a length of the ground pattern extending from the ground terminal to part of the fourth side wall; a length as a distance from a point of connection with the ground pattern to a top of the fourth side wall; a length as a distance on the top wall from this point on a top to the first or second corner; and a length as a distance from a top of the first, second or third side wall to its bottom.

As a seventh solution, the antenna consists of a base made of an insulating material, an antenna element wound around the outer face of the base and transmission and reception terminals and a ground terminal which are provided on the outer face of the base, and with the antenna element lying over a notch made along the first side wall on the circuit board, both ends of the base rest on the circuit board while the transmission and reception terminals are connected to the wiring pattern and the ground terminal is connected to the ground pattern.

As an eighth solution, the antenna has conductive connections which are connected with the transmission and reception terminals and the ground terminal, respectively; the connections connected with the transmission and reception terminals are connected to the wiring pattern while the connection connected with the ground terminal is connected to the ground pattern and constitutes part of an electrical length of the ground conductor.

As a ninth solution, the transmission/reception unit, the base is made of ceramic.

BRIEF DESCRIPTION OF THE DRAWINGS

The invention will be more particularly described with reference to the accompanying drawings, in which.

DETAILED DESCRIPTION OF THE PREFERRED EMBODIMENTS

Figure 1:
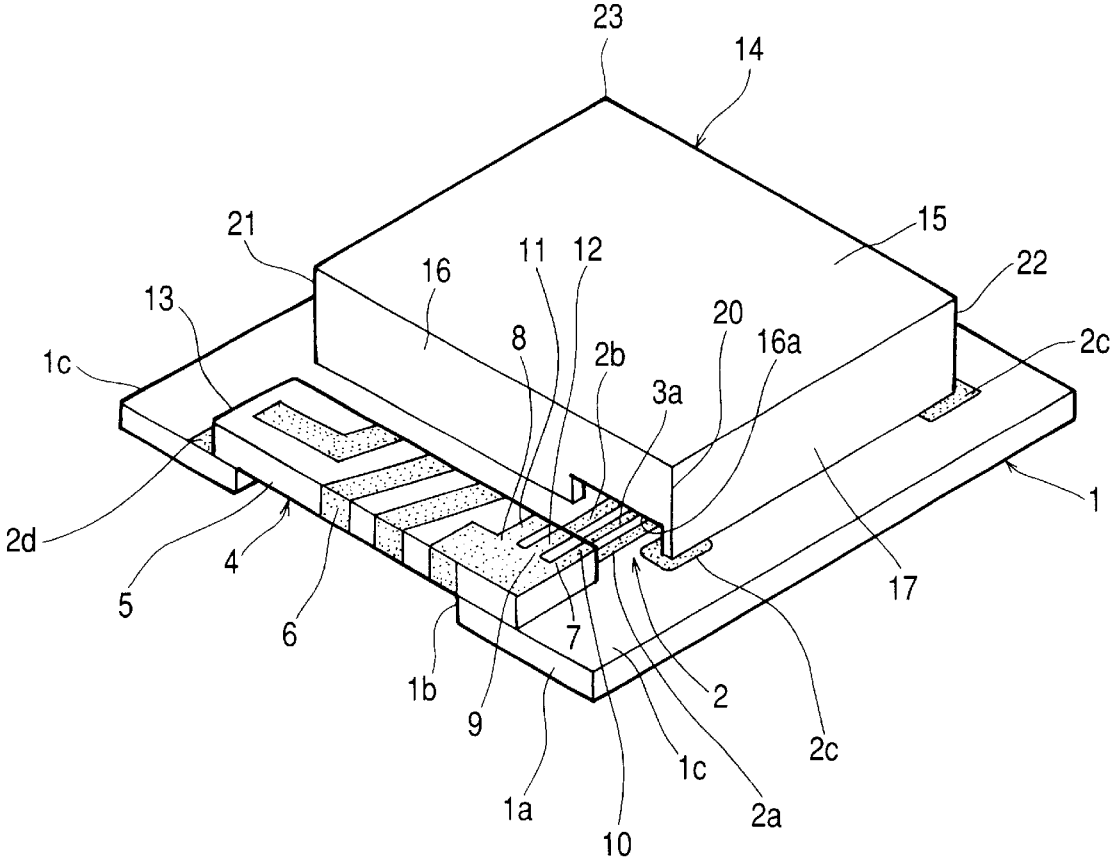
FIG. 1 is a perspective view of a transmission/reception unit as assembled according to a first embodiment of the present invention.
Figure 2:
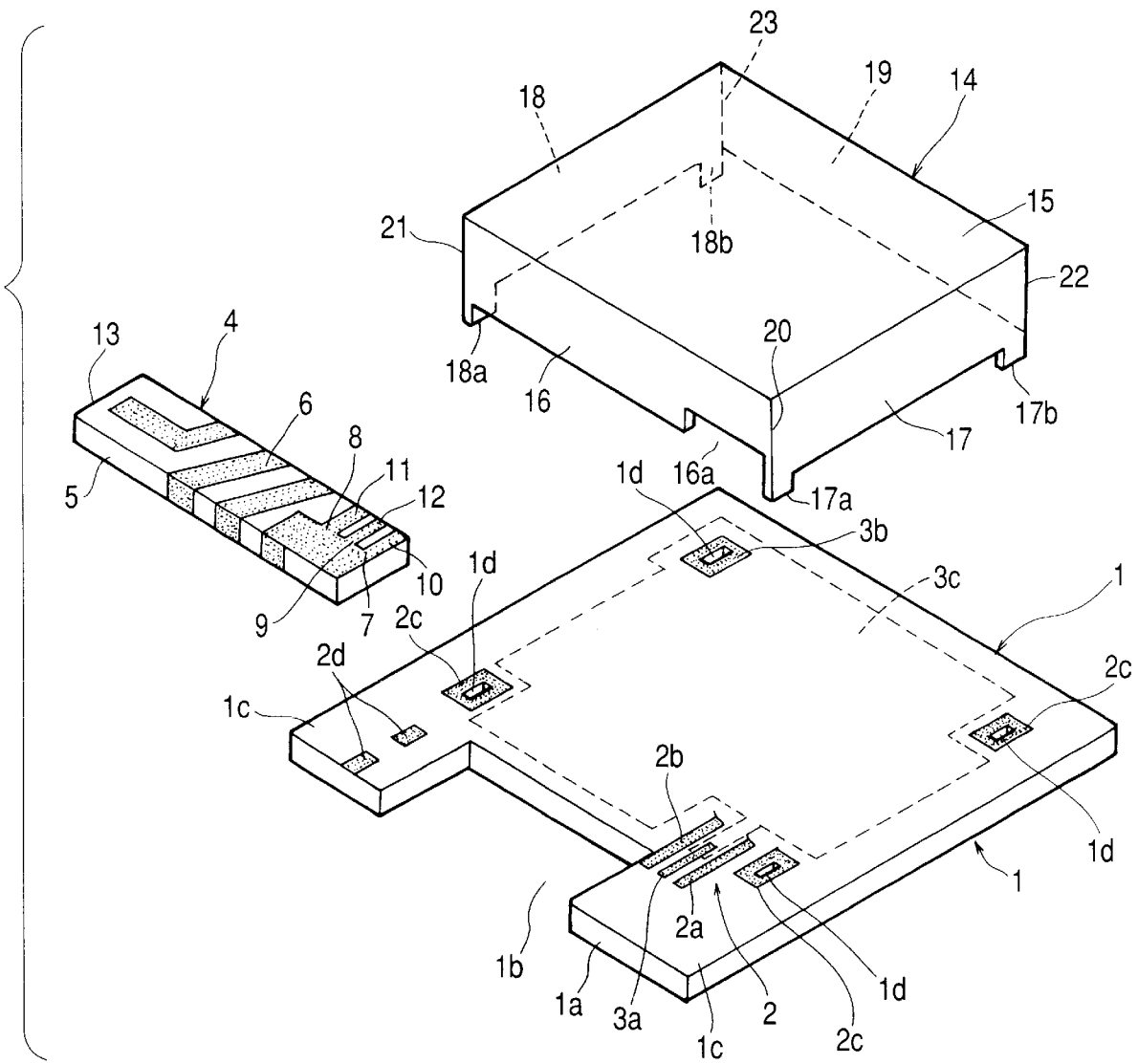
FIG. 2 is a perspective exploded view of the transmission/reception unit according to the first embodiment of the present invention.
Figure 3:
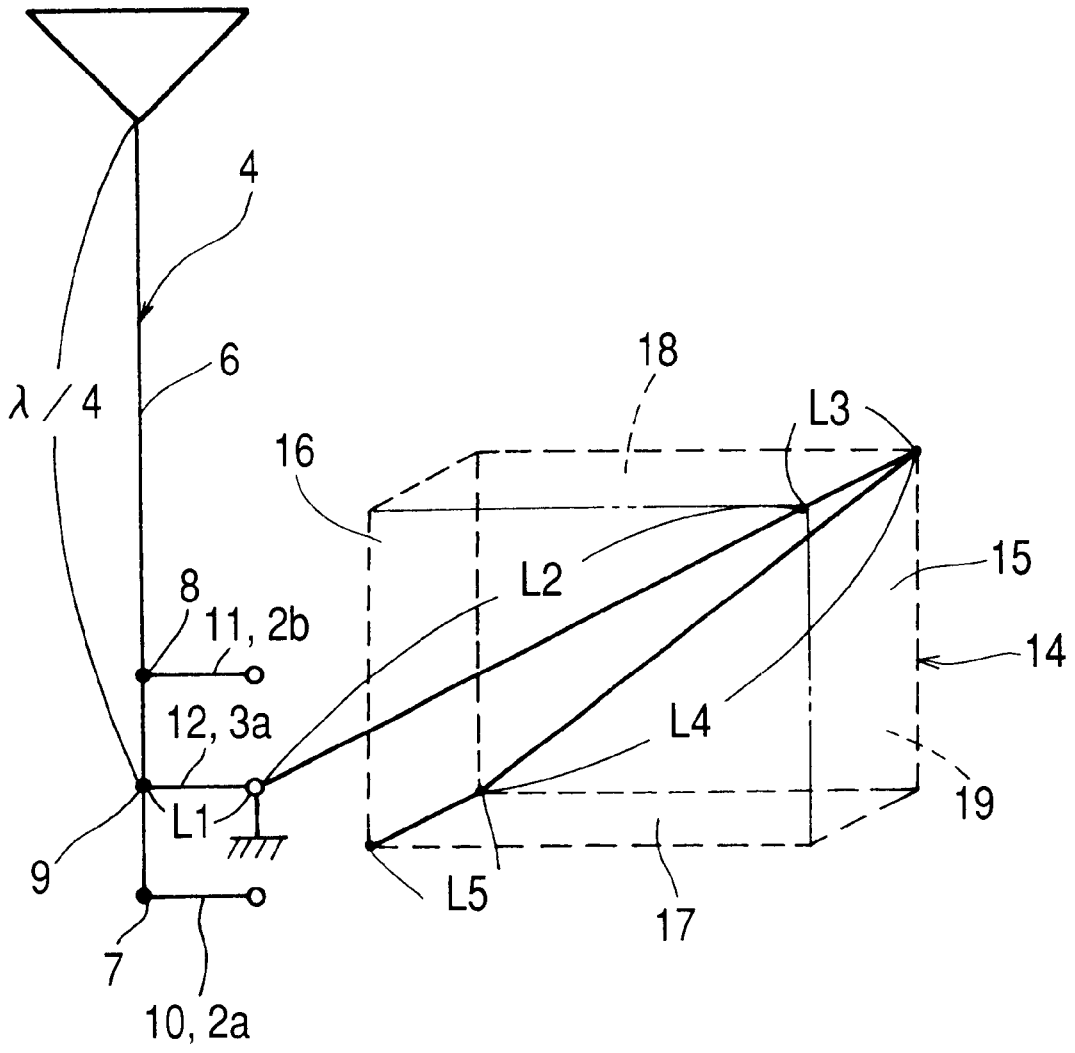
FIG. 3 illustrates the electrical length of a ground conductor connected with the ground terminal of the antenna in the transmission/reception unit according to the first embodiment of the present invention.
Figure 4:
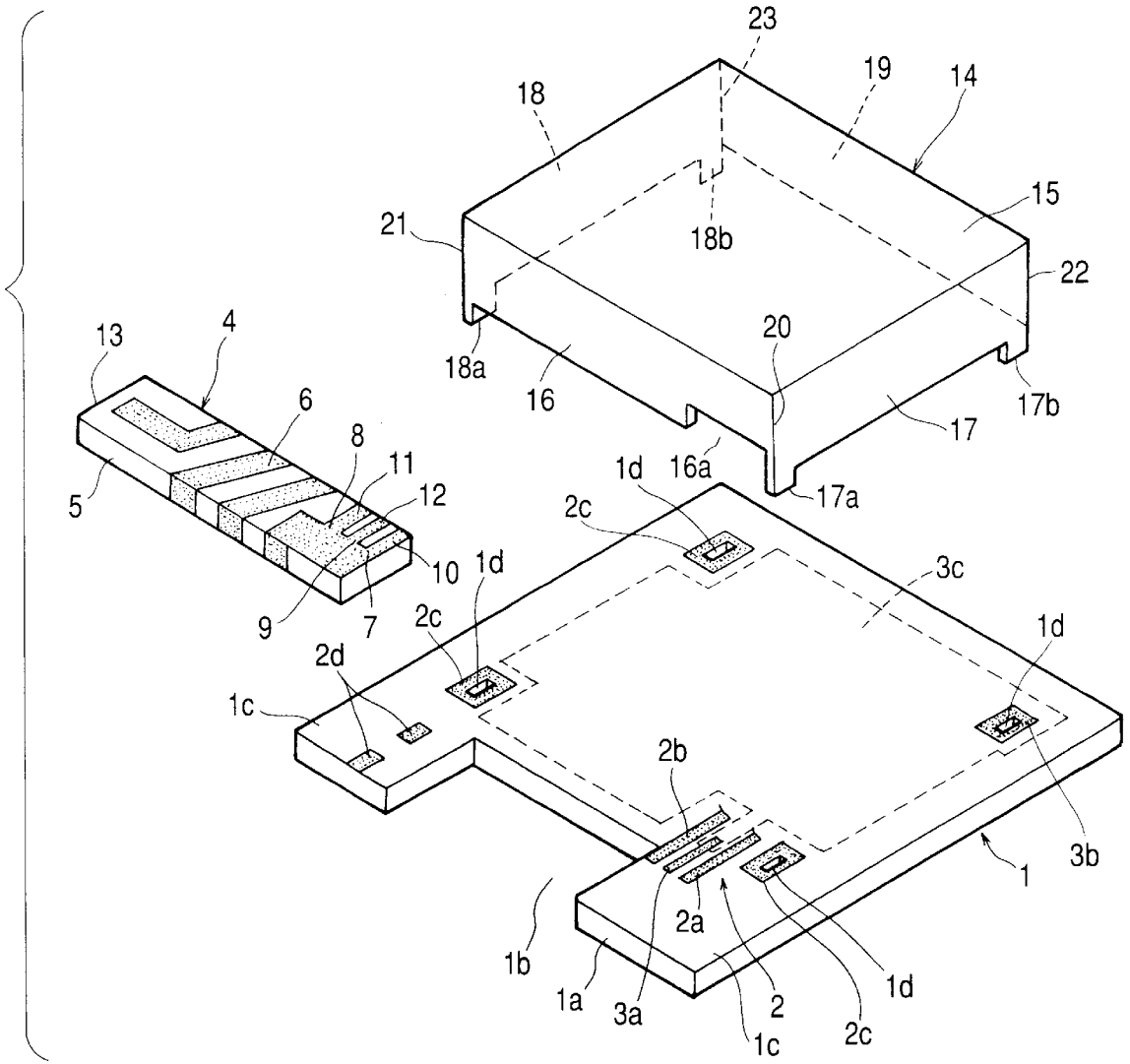
FIG. 4 is a perspective exploded view of a transmission/reception unit according to a second embodiment of the present invention.

Next, a transmission/reception unit according to the present invention will be described in detail referring to the following drawings: FIG. 1, a perspective view of a transmission/reception unit as assembled according to a first embodiment of the present invention; FIG. 2, a perspective exploded view of the transmission/reception unit according to the first embodiment; FIG. 3, a figure which illustrates the electrical length of a ground conductor connected with the ground terminal of the antenna in the transmission/reception unit according to the first embodiment; FIG. 4, a perspective exploded view of a transmission/reception unit according to a second embodiment; and FIG. 5, a figure which illustrates the electrical length of a ground conductor connected with the ground terminal of the antenna in the transmission/reception unit according to the second embodiment.

Figure 6:
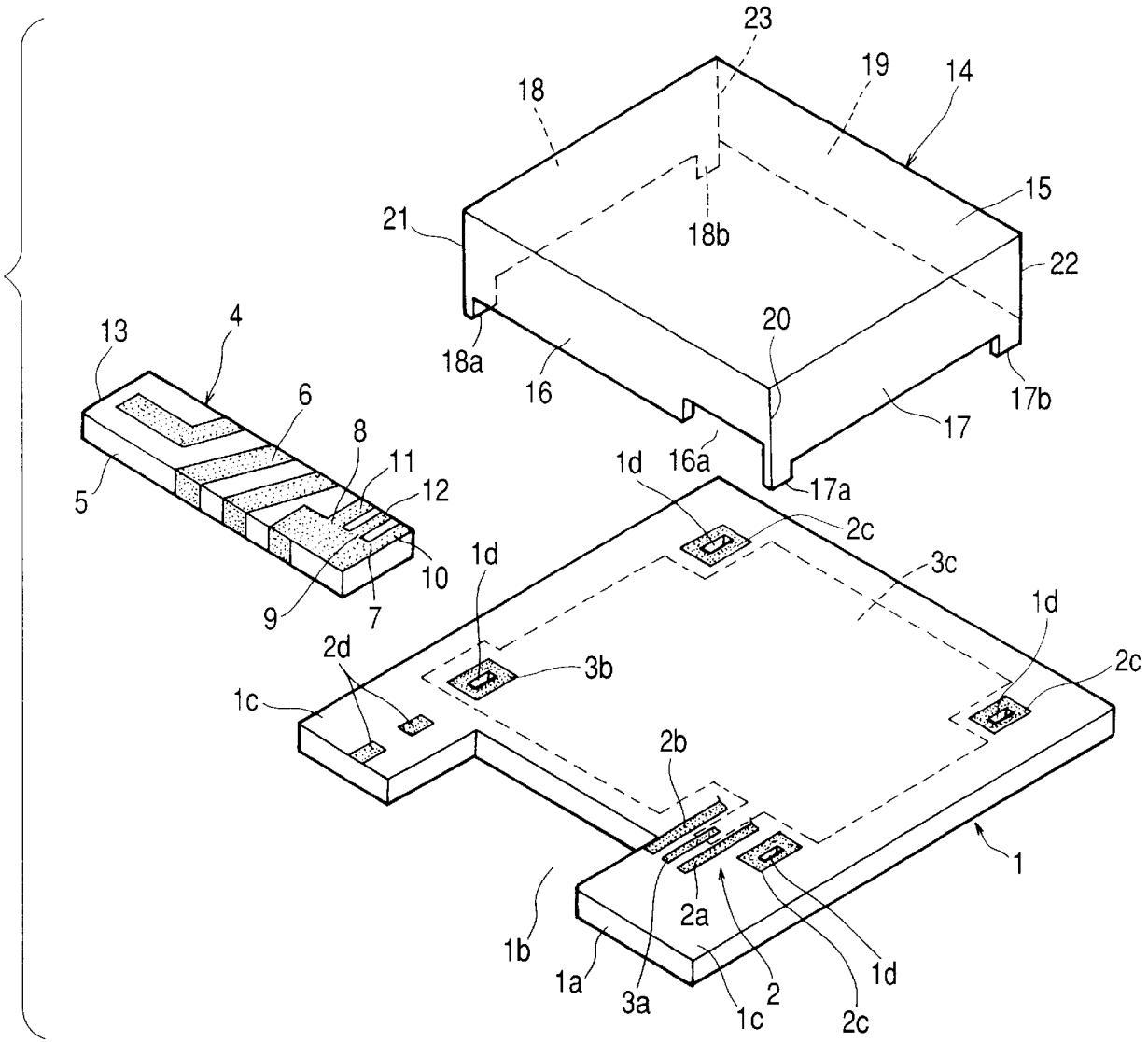
FIG. 6 is a perspective exploded view of a transmission/reception unit according to a third embodiment of the present invention.
Figure 7:
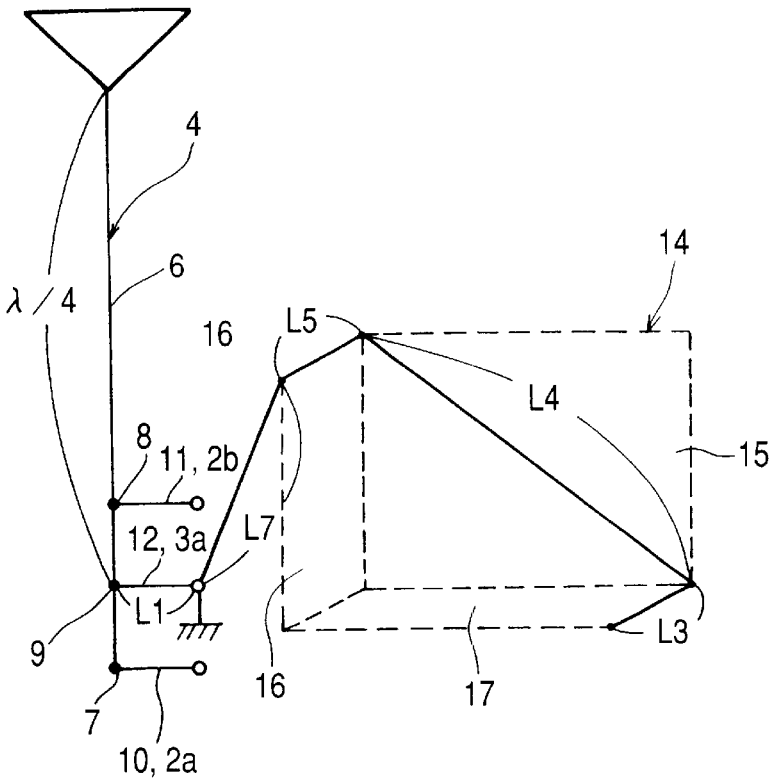
FIG. 7 illustrates the electrical length of a ground conductor connected with the ground terminal of the antenna in the transmission/reception unit according to the third embodiment of the present invention.
Figure 8:
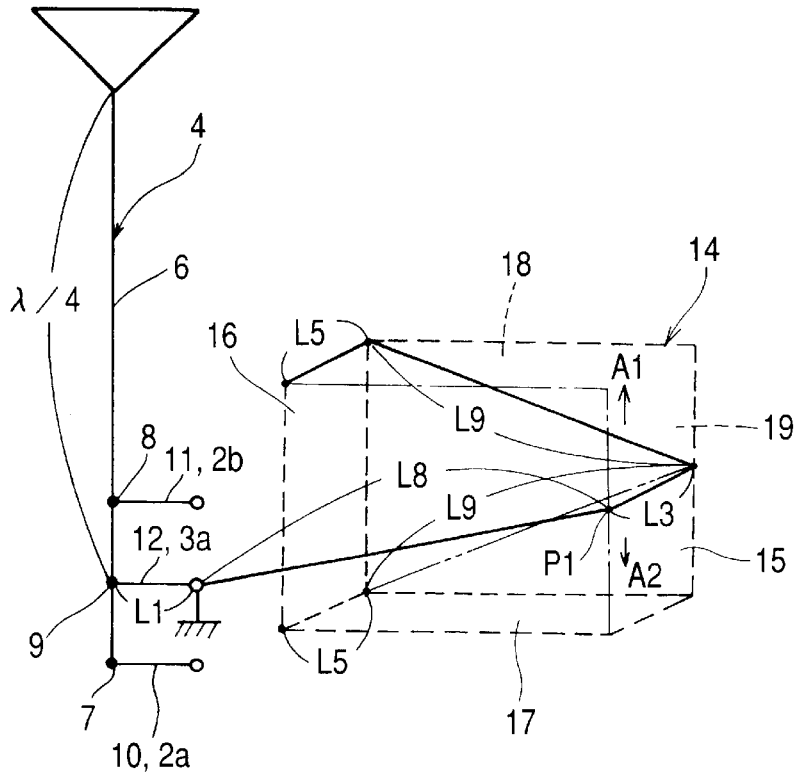
FIG. 8 illustrates the electrical length of a ground conductor connected with the ground terminal of the antenna in a transmission/reception unit according to a fourth embodiment of the present invention.

Also, FIG. 6, a perspective exploded view of a transmission/reception unit according to a third embodiment; FIG. 7, a figure which illustrates the electrical length of a ground conductor connected with the ground terminal of the antenna in the transmission/reception unit according to the third embodiment; FIG. 8, a figure which illustrates the electrical length of a ground conductor connected with the ground terminal of the antenna in a transmission/reception unit according to a fourth embodiment; and FIG. 9, a figure which illustrates the electrical length of a ground conductor connected with the ground terminal of the antenna in the transmission/reception unit according to a fifth embodiment.

According to the first embodiment of the present invention, the structure of a transmission/reception unit will be explained below with reference to FIGS. 1 to 3. A circuit board 1 such as a multi-layer printed circuit board has: a notch 1*b* extending across the thickness of the board from one end 1*a* toward the center; a pair of narrow portions 1*c* facing each other with the notch 1*b* between them; and four holes 1*d* made in the four corners of a square area.

The notch 1*b* may be a through-hole made in the circuit board 1 by cutting an area adjacent to the one end 1*a*.

On the circuit board 1, there are a conductive pattern 2 consisting of conductive patterns 2*a* and 2*b* located near the notch 1*b*, conductive patterns 2*c* located around three holes 1*d* and conductive patterns 2*d* located on one of the narrow portions 1*c*, a ground pattern 3*a* located between the conductive patterns 2*a* and 2*b*, and a ground pattern 3*b* around the hole id located diagonally to the hole id near the ground pattern 3*a*.

On the rear face of the circuit board 1 or in the layers of the multi-layer circuit board 1 is a ground pattern 3*c* which is electrically connected with the ground patterns 3*a* and 3*b* on the front face of the circuit board The ground pattern 3*c* is electrically connected with the ground patterns 3*a* and 3*b* via the connecting conductor (not shown), etc. filled in a through-hole (not shown) made in the circuit board 1.

The conductive patterns 2*a* and 2*b* as part of the wiring pattern 2 are connected to various electric components (not shown) which make up transmission and reception circuitry.

A chip type antenna 4 consists of the following: a plate type base 5 made of an insulating material such as ceramic; an antenna element 6 which is formed from a conductor on the outer face of the base 5 and wound around the base 5 by baking or a similar technique; transmission and reception terminals 7 and 8, and a ground terminal 9 which are provided at one end of the antenna element 6 on the outer face of the base 5; connections 10, 11 and 12 with which the transmission and reception terminals 7 and 8 and the ground terminal 9 are connected; and a pair of electrodes 13 on the end face of the base 5.

The connections 10, 11 and 12 and the electrodes 13 are formed from a conductor by baking or a similar technique, like the antenna element 6.

This chip type antenna 4 is placed on the circuit board 1 with its antenna element 6 over the notch 1*b* and the ends of the base 5 on the narrow portions 1*c*.

Here, the connections 10, 11, and 12 connected with the transmission and reception terminals 7 and 8 and ground terminal 9 of the antenna element 6 should coincide with the conductive patterns 2*a* and 2*b* and ground pattern 3*a* and also the electrodes 13 should coincide with the conductive patterns 2*d*. With the antenna 4 placed on the circuit board 1 in this way, the connections 10, 11 and 12 are soldered to the conductive patterns 2*a* and 2*b* and ground pattern 3*a*, respectively, and the electrodes 13 are soldered to the conductive patterns 2*d* so that the antenna 4 is mounted on the circuit board 1 in a prescribed manner.

The cover 14, which is in the form of a cubic or hexahedral box, is made of sheet metal. It has a square top wall 15, a first side wall 16, a second side wall 17, a third side wall 18 and a fourth side wall 19, a notch 16*a* made at the bottom of the first side wall 16, and four corners 20, 21, 22 and 23 (first, second, third and fourth corners, respectively), where the side walls are formed by bending the four sides of the top wall 15, and the first corner 20 is defined by the first and second side walls 16 and 17, the second corner 21 by the first and third side walls 16 and 18, the third corner by the second and fourth side walls 17 and 19, and the fourth corner 23 by the third and fourth side walls 18 and 19.

In addition, the cover 14 has four mounting legs: a leg 17*a* is provided at the bottom of the first corner 20 or the second side wall 17 adjacent to the corner 20; a leg 17*b* is provided at the bottom of the third corner 22 or the second side wall 17 adjacent to the corner 22; a leg 18*a* is provided at the bottom of the second corner 21 or the third side wall 18 adjacent to the corner 21; and a leg 18*b* is provided at the bottom of the fourth corner 23 or the third side wall 18 adjacent to the corner 23.

The cover 14 rests on the circuit board 1 in a way that it covers the electric components arranged on the circuit board 1 except the antenna 4, and the mounting legs 17*a*, 17*b*, and 18*a* and 18*b* are passed through the holes 1*d* and soldered to the wiring pattern 2 and ground pattern 3*b*; in this way, the cover 14 is mounted and fixed on the circuit board 1.

With the cover in place, the mounting legs 17*a*, 17*b*, and 18*a* are electrically connected with the conductive patterns 2*c* constituting part of the non-ground wiring pattern 2 while the mounting leg 18*b* is electrically connected with the ground pattern 3*b*; the antenna element 6 of the antenna 4 is laid along the first side wall 16 with its transmission and reception terminals 7 and 8 and its ground terminal 9 located in the vicinity of the first corner 20.

Also, with the cover 14 in place, there is a notch 16*a* above the conductive patterns 2*a* and 2*b* and the ground pattern 3*a* respectively connected with the transmission and reception terminals 7 and 8 and ground terminal 9 of the antenna 4 so that the cover 14 is electrically isolated from these.

The ground pattern 3*a* is connected to the ground pattern 3*c*, which is connected through the ground pattern 3*b* to the fourth corner 23 of the cover 14 or the vicinity of the corner 23. The transmission/reception unit according to the present invention is structured as stated above.

FIG. 3 illustrates the electrical length of a ground conductor connected with the ground terminal 9 of the antenna 4 in the transmission/reception unit according to the first embodiment of the present invention. As shown in the figure, the electrical length L of the ground conductor according to the first embodiment of the present invention is the sum of the following lengths: a length L1 of the connection 12 and ground pattern 3*a* between the ground terminal 9 and the ground pattern 3*c* on the circuit board 1; a length L2 of the ground pattern 3*c* extending from the ground pattern 3*a* to the fourth corner 23 or the vicinity of the fourth corner 23; a length L3 as the distance from the point of connection with the ground pattern 3*c* to the top of the third or fourth side wall (18 or 19); a length L4 as the distance on the top wall 15 from the fourth corner 23 to the first corner 20; and length L5 as the distance from the top of the first or second side wall (16 or 17) to its bottom.

Namely, the electrical length L of the ground conductor is expressed by L1+L2+L3+L4+L5. Therefore, the electrical length L is far longer than that in the conventional unit.

Figure 5:
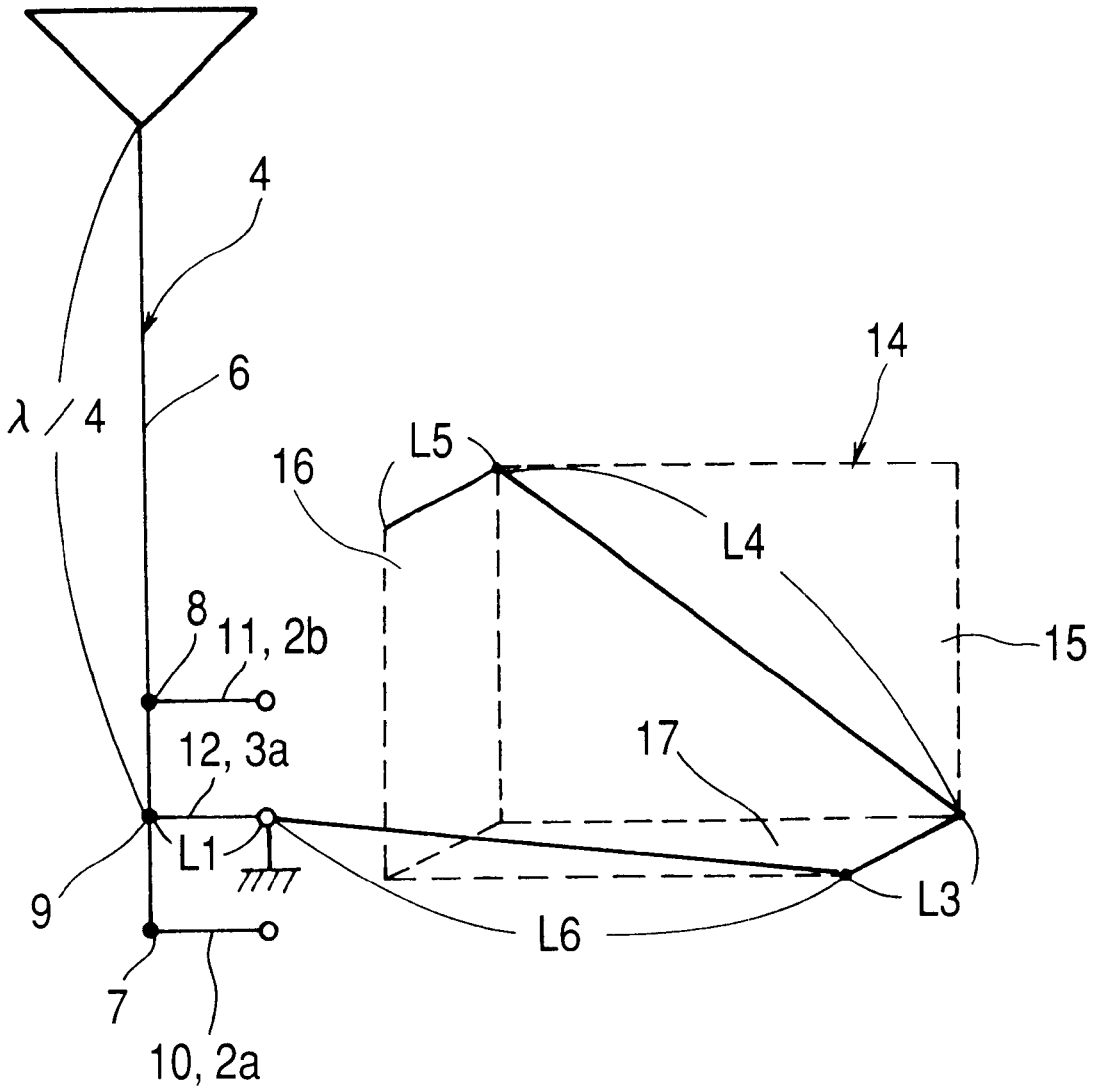
FIG. 5 illustrates the electrical length of a ground conductor connected with the ground terminal of the antenna in the transmission/reception unit according to the second embodiment of the present invention.

FIGS. 4 and 5 show a second embodiment of the present invention. In the second embodiment, the ground pattern 3*b* is located around the hole id at the base of the third corner 22 of the cover 14 while the non-ground patterns 2*c* are located around the holes 1*d* at the base of the first, second and fourth corners (20, 21, 23). The other components are the same as those of the first embodiment as mentioned above so the same components are marked with the same reference numerals and their description is omitted here.

FIG. 5 illustrates the electrical length of a ground conductor connected with the ground terminal 9 of the antenna 4 in the transmission/reception unit according to the second embodiment of the present invention. As shown in the figure, the electrical length L of the ground conductor according to the second embodiment of the present invention is the sum of the following lengths: a length L1 of the connection 12 and ground pattern 3*a* between the ground terminal 9 and the ground pattern 3*c* on the circuit board 1; a length L6 of the ground pattern 3*c* extending from the ground pattern 3*a* to the third corner 22 or the vicinity of the third corner 22; a length L3 as the distance from the point of connection with the ground pattern 3*c* to the top of the second or fourth side wall (17 or 19); a length L4 as the distance on the top wall 15 from the third corner 22 to the second corner 21; and a length L5 as the distance from the top of the first or third side wall (16 or 18) to its bottom.

Namely, the electrical length L of the ground conductor is expressed by L1+L6+L3+L4+L5. Therefore, the electrical length L is far longer than that in the conventional unit.

FIGS. 6 and 7 show a third embodiment of the present invention. In the third embodiment, the ground pattern 3*b* is located around the hole 1*d* at the base of the second corner 21 of the cover 14 while the non-ground patterns 2*c* are located around the holes 1*d* at the base of the first, third and fourth corners (20, 22, 23). The other components are the same as those of the first embodiment so the same components are marked with the same reference numerals and their description is omitted here.

FIG. 7 illustrates the electrical length of a ground conductor connected with the ground terminal 9 of the antenna 4 in the transmission/reception unit according to the third embodiment of the present invention. As shown in the figure, the electrical length L of the ground conductor according to the third embodiment of the present invention is the sum of the following lengths: a length L1 of the connection 12 and ground pattern 3*a* between the ground terminal 9 and the ground pattern 3*c* on the circuit board 1; a length L7 of the ground pattern 3*c* extending from the ground pattern 3*a* to the second corner 21 or the vicinity of the second corner 21; a length L5 as the distance from the point of connection with the ground pattern 3*c* to the top of the first or third side wall (16 or 18); a length L4 as the distance on the top wall 15 from the second corner 21 to the third corner 22; and a length L3 as the distance from the top of the second or fourth side wall (17 or 19) to its bottom.

Namely, the electrical length L of the ground conductor is expressed by L1+L7+L5+L4+L3. Therefore, the electrical length L is far longer than that in the conventional unit.

FIG. 8 shows a fourth embodiment of the present invention. In the fourth embodiment, part of the middle of the fourth side wall 19 of the cover 14 is connected through the ground pattern 3*b* to the ground pattern 3*c*. The other components are the same as those of the first embodiment so the same components are marked with the same reference numerals and their description is omitted here.

FIG. 8 illustrates the electrical length of a ground conductor connected with the ground terminal 9 of the antenna 4 in the transmission/reception unit according to the fourth embodiment of the present invention. As shown in the figure, the electrical length L of the ground conductor according to the fourth embodiment of the present invention is the sum of the following lengths: a length L1 of the connection 12 and ground pattern 3*a* between the ground terminal 9 and the ground pattern 3*c* on the circuit board 1; a length L8 as the distance from the ground pattern 3*a* to part of the middle of the fourth side wall 19; a length L3 as the distance from the point of connection with the ground pattern 3*c* to the top of the fourth side wall 19; a length L9 as the distance on the top wall 15 from this point on the top to the first or second corner (20 or 21); and length L5 as the distance from the top of the first, second or third side wall (16, 17 or 18) to its bottom.

Namely, the electrical length L of the ground conductor is expressed by L1+L8+L3+L9+L5. Therefore, the electrical length L is far longer than that in the conventional unit.

In the fourth embodiment as illustrated in FIG. 8, assuming that the connection point P1 of the fourth side wall 19 is shifted from the center towards the fourth corner 23 in the direction of arrow A1, as the connection point P1 gradually comes closer to the fourth corner 23, length L8 (FIG. 8) increases, and also L9 (FIG. 8), which represents the distance from a new point nearer to the fourth corner 23 to the first corner 20, increases; thus the electrical length L increases gradually.

Furthermore, in the fourth embodiment as illustrated in FIG. 8, assuming that the connection point P1 of the fourth side wall 19 is shifted from the center towards the third corner 22 in the direction of arrow A2, as the connection point P1 gradually comes closer to the third corner 22, length L8 (FIG. 8) slightly decreases, but L9 (FIG. 8), which represents the distance from a new point nearer to the third corner 22 to the second corner 21, increases; thus the electrical length L slightly increases gradually.

Figure 9:
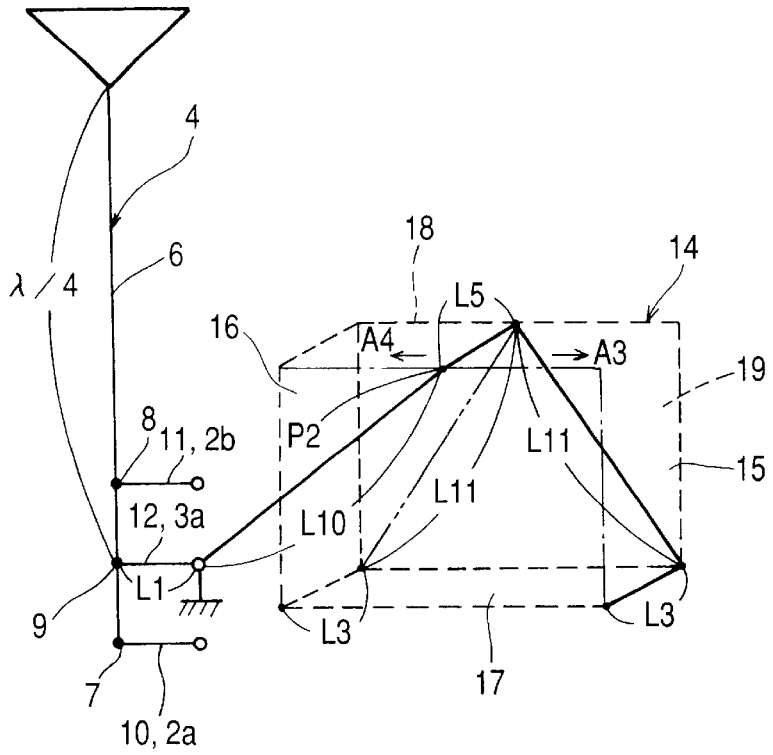
FIG. 9 illustrates the electrical length of a ground conductor connected with the ground terminal of the antenna in the transmission/reception unit according to a fifth embodiment of the present invention.
Figure 10:
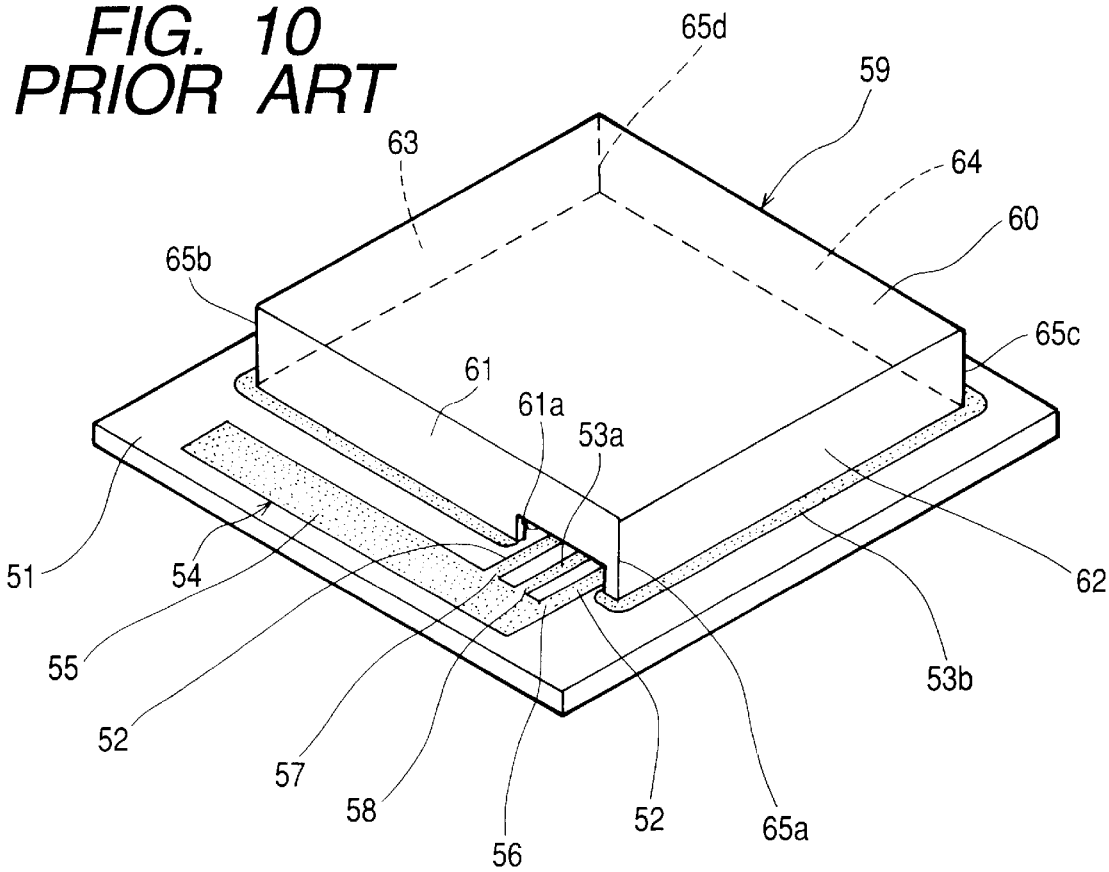
FIG. 10 PRIOR ART
FIG. 10 is a perspective view of a conventional transmission/reception unit as assembled.
Figure 11:
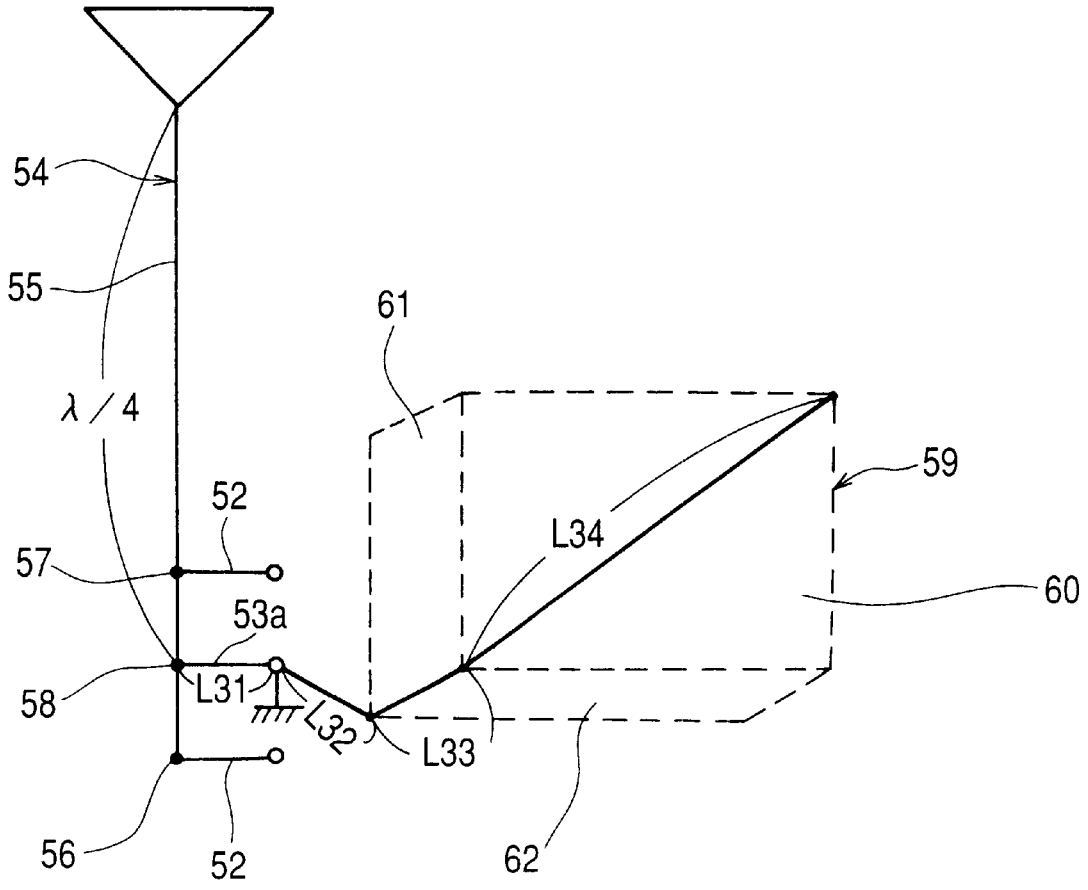
FIG. 11 PRIOR ART
FIG. 11 illustrates the electrical length of a ground conductor connected with the ground terminal of the antenna in the conventional transmission/reception unit.

FIG. 9 shows a fifth embodiment of the present invention. In the fifth embodiment, part of the middle of the third side wall 18 is connected through the ground pattern 3*b* to the ground pattern 3*c*. The other components are the same as those of the first embodiment so the same components are marked with the same reference numerals and their description is omitted here.

FIG. 9 illustrates the electrical length of a ground conductor connected with the ground terminal 9 of the antenna 4 in the transmission/reception unit according to the fifth embodiment of the present invention. As shown in the figure, the electrical length L of the ground conductor according to the fifth embodiment of the present invention is the sum of the following lengths: a length L1 of the connection 12 and ground pattern 3*a* between the ground terminal 9 and the ground pattern 3*c* on the circuit board 1; a length L10 as the distance from the ground pattern 3*a* to part of the middle of the third side wall 18; a length L5 as the distance from the point of connection with the ground pattern 3*c* to the top of the third side wall 18; a length L11 as the distance on the top wall 15 from this point on the top to the first or third corner (20 or 22); and a length L3 as the distance from the top of the first, second or fourth side wall (16, 17 or 19) to its bottom.

Namely, the electrical length L of the ground conductor is expressed by L1+L10+L5+L11+L3. Therefore, the electrical length L is far longer than that in the conventional unit.

In the fifth embodiment as illustrated in FIG. 9, assuming that the connection point P2 of the third side wall 18 is shifted from the center towards the fourth corner 23 in the direction of arrow A3, as the connection point P2 gradually comes closer to the fourth corner 23, the length L10 (FIG. 9) increases, and also the length L11 (FIG. 9), which represents the distance from a new point nearer to the fourth corner 23 to the first corner 20, increases; thus the electrical length L increases gradually.

Furthermore, in the fifth embodiment as illustrated in FIG. 9, assuming that the connection point P2 of the third side wall 18 is shifted from the center towards the second corner 21 in the direction of arrow A4, as the connection point P2 gradually comes closer to the second corner 21, the length L10 (FIG. 9) slightly decreases, but the length L11 (FIG. 9), which represents the distance from a new point nearer to the second corner 21 to the third corner 22, increases; thus the electrical length L slightly increases gradually Recently, in order to meet the growing demand for a compact unit, efforts to reduce the size of the circuit board 1 and, the cover 14 in particular, the proportions of which are large, have been pursued. According to the first to fifth embodiments of the present invention, the transmission/reception unit has the structure as described above and thus the electrical length L of the ground conductor from the ground terminal 9 can be much longer than in the conventional unit.

In addition, the first to fifth embodiments of the present invention offer different options of the electrical length L in the transmission/reception unit so the electrical length L can be chosen freely.

Consequently, an electrical length L equivalent to the length $\lambda/4$ of the antenna element 6 can be obtained and, even when the circuit board 1 or the cover 14 has a different size, an electrical length L equivalent to $\lambda/4$ can be easily obtained according to their size.

As described above, the first to fifth embodiments assume that the antenna element 6 of the antenna 4 has connections 10, 11 and 12 to be connected with the transmission and reception terminals 7 and 8 and the ground terminal 9, respectively; however, these connections 10, 11 and 12 may be omitted and, instead the transmission and reception terminals 7 and 8 and the ground terminal 9 may be directly connected to the conductive patterns 2*a* and 2*b* and the ground pattern 3*a*, respectively.

The antenna element 6 of the antenna 4 may be formed on the circuit board 1.

In the first embodiment, either of the second and third corners (21, 23) of the cover 14 or both may be connected to the ground pattern.

In the transmission/reception unit according to the present invention, the first corner 20 of the cover 14, which is located in the vicinity of the transmission and reception terminals 7 and 8 and ground terminal 9 of the antenna 4, or the vicinity of the corner 20, is soldered to the non-ground wiring pattern 2*c*; also the second corner 21 or its vicinity, the third corner 22 or its vicinity, the fourth corner 23 (located diagonally to the first corner 20) or its vicinity, or part of the third or fourth side wall (18 or 19) is connected to the ground pattern. Accordingly, the electrical length L of the ground conductor from the ground terminal 9 can be increased and therefore an electrical length L equivalent to $\lambda/4$ can be obtained even in a compact transmission/reception unit with resulting improvement in antenna gain and transmission/reception sensitivity.

The fourth corner 23 or its vicinity is connected to the ground pattern; and the electrical length of the ground conductor connected to the ground terminal 9 of the antenna 4 consists of: the length of the ground pattern extending from the ground terminal 9 to the fourth corner 23 or its vicinity; the length as the distance from the point of connection with the ground pattern to the top of the third or fourth side wall (18 or 19); the length as the distance on the top wall 15 between the first corner 20 and the fourth corner 23; and the length as the distance from the top of the first or second side wall (16 or 17) to its bottom. Accordingly, the electrical length L of the ground conductor from the ground terminal 9 can be increased and therefore an electrical length L equivalent to $\lambda/4$ can be obtained even in a compact transmission/reception unit with resulting improvement in antenna gain and transmission/reception sensitivity.

The third corner 22 or its vicinity is connected to the ground pattern; and the electrical length of the ground conductor connected to the ground terminal 9 of the antenna 4 consists of the length of the ground pattern extending from the ground terminal 9 to the third corner 22 or its vicinity; the length as the distance from the point of connection with the ground pattern to the top of the second or fourth side wall (17 or 19); the length as the distance on the top wall 15 between the second corner 21 and the third corner 22; and the length as the distance from the top of the first or third side wall (16 or 18) to its bottom. Accordingly, the electrical length L of the ground conductor from the ground terminal 9 can be increased and therefore an electrical length L equivalent to $\lambda/4$ can be obtained even in a compact transmission/reception unit.

The second corner 21 or its vicinity is connected to the ground pattern and the electrical length of the ground conductor connected to the ground terminal 9 of the antenna 4 consists of: the length of the ground pattern extending from the ground terminal 9 to the second corner 21 or its vicinity; the length as the distance from the point of connection with the ground pattern to the top of the first or third side wall (16 or 18); the length as the distance on the top wall 15 between the second corner 21 and the third corner 22; and the length as the distance from the top of the second or fourth side wall (17 or 19) to its bottom. Accordingly, the electrical length L of the ground conductor from the ground terminal 9 can be increased and therefore an electrical length L equivalent to $\lambda/4$ can be obtained even in a compact transmission/reception unit.

Part of the third side wall 18 located between the second corner 21 and the fourth corner 23 is connected to the ground pattern and the electrical length of the ground conductor connected to the ground terminal 9 of the antenna 4 consists of: the length of the ground pattern extending from the ground terminal 9 to part of the third side wall 18; the length as the distance from the point of connection with the ground pattern to the top of the third side wall 18; the length as the distance on the top wall 15 from this point on the top to the first or third corner (20 or 22); and the length as the distance from the top of the first, second or fourth side wall (16, 17 or 19) to its bottom. Accordingly, the electrical length L of the ground conductor from the ground terminal 9 can be increased and therefore an electrical length L equivalent to $\lambda/4$ can be obtained even in a compact transmission/reception unit.

Part of the fourth side wall 19 located between the third corner 22 and the fourth corner 23 is connected to the ground pattern and the electrical length of the ground conductor connected to the ground terminal 9 of the antenna 4 consists of: the length of the ground pattern extending from the ground terminal 9 to part of the fourth side wall 19; the length as the distance from the point of connection with the ground pattern to the top of the fourth side wall 19; the length as the distance on the top wall 15 from this point on the top to the first or second corner (20 or 21); and the length as the distance from the top of the first, second or third side wall (16, 17 or 18) to its bottom. Accordingly, the electrical length L of the ground conductor from the ground terminal 9 can be increased and therefore an electrical length L equivalent to $\lambda/4$ can be obtained even in a compact transmission/reception unit.

The antenna 4 consists of the following: a base 5 made of an insulating material; an antenna element 6 wound around the outer face of the base 5; transmission and reception terminals 7 and 8, and a ground terminal 9 which are provided on the outer face of the base 5. Here, with the antenna element 6 lying over a notch 1*b* made along the first side wall 16 on the circuit board 1, both ends of the base 5 rest on the circuit board 1 while the transmission and reception terminals 7 and 8 are connected to the wiring patterns 2*a* and 2*b* and the ground terminal 9 is connected to the ground pattern 3*a*. Because the antenna element 6 is wound around the base 5, the antenna element 6 can have the required length even though the base 5 is short. This permits reduction in the width of the circuit board 1, which realizes a compact transmission/reception unit.

Also, with the antenna element 6, provided on the base 5 of the antenna 4, lying over the notch 1*b* of the circuit board 1, the antenna element 6 is exposed, or not covered by the upper (front) and lower (rear) faces of the circuit board 1, so that a transmission/reception unit with reduced loss in radio wave radiation and radio wave reception can be realized.

In addition, the antenna 4 has conductive connections 10, 11, and 12 which are connected with the transmission and reception terminals 7 and 8 and the ground terminal 9, respectively; the connections 10 and 11 connected with the transmission and reception terminals 7 and 8 are connected to the wiring patterns 2*a* and 2*b* while the connection 12 connected with the ground terminal 9 is connected to the ground pattern 3*a*. This makes it easy to mount the antenna 4 on the circuit board 1, leading to improvement in productivity.

Another merit is that the connection 12, which is connected with the ground terminal 9, constitutes part of the electrical length L of the ground conductor, so the electrical length is increased.

In addition, since the base 5 is made of ceramic, the dielectric constant is large; therefore, a small chip type antenna 4 can be realized, which means that the size of the circuit board 1 can be reduced and a compact transmission/reception unit can be realized.

What is claimed is:

1. A transmission/reception unit comprising:

a circuit board having a wiring pattern including various electric components;

a cover made of sheet metal which is mounted to cover the electric components and has one of a cubic and hexahedral box shape; and an antenna mounted on the circuit board, the cover having:

a top wall;

a first, a second, a third and a fourth side walls which are formed by bending four sides of the top wall;

a first corner defined by the neighboring first and second side walls;

a second corner defined by the first side wall and the neighboring third side wall;

a third corner defined by the second side wall and the neighboring fourth side wall; and a fourth corner defined by the neighboring third and fourth side walls, the antenna having:

an antenna element as a conductor laid along the first side wall of the cover; and transmission and reception terminals and a ground terminal which are provided in a vicinity of the first corner and located at one end of the antenna element, wherein the ground terminal is connected to a ground pattern provided on the circuit board, wherein one of the first corner of the cover and the vicinity of the first corner is soldered to the non-ground wiring pattern, and wherein the ground pattern is connected with one of:

one of the second corner and a vicinity of the second corner, one of the third corner and a vicinity of the third corner, one of the fourth corner, located diagonally to the first corner, and a vicinity of the fourth corner, and one of part of the third and fourth side wall.

2. The transmission/reception unit according to claim 1, wherein one of the fourth corner and the vicinity of the fourth corner is connected to the ground pattern, and wherein an electrical length of the ground conductor connected to the ground terminal of the antenna comprises:

a length of the ground pattern extending from the ground terminal to the one of the fourth corner and the vicinity of the fourth corner;

a length from a point of connection with the ground pattern to a top of one of the third and fourth side wall;

a length on the top wall between the first corner and the fourth corner; and a length from a top of one of the first and second side wall to a bottom of the one of the first and second side wall.

3. The transmission/reception unit according to claim 1, wherein one of the third corner and the vicinity of the third corner is connected to the ground pattern, and wherein an electrical length of the ground conductor connected to the ground terminal of the antenna comprises:

a length of the ground pattern extending from the ground terminal to the one of the third corner and the vicinity of the third corner;

a length from a point of connection with the ground pattern to a top of one of the second and fourth side wall;

a length on the top wall between the second corner and the third corner; and the length from a top of one of the first and third side wall to a bottom of the one of the first and third side wall.

4. The transmission/reception unit according to claim 1, wherein one of the second corner and the vicinity of the second corner is connected to the ground pattern, and wherein an electrical length of the ground conductor connected to the ground terminal of the antenna comprises:

a length of the ground pattern extending from the ground terminal to one of the second corner and the vicinity of the second corner;

a length from a point of connection with the ground pattern to a top of one of the first and third side wall;

a length on the top wall between the second corner and the third corner; and a length from a top of one of the second and fourth side wall to a bottom of one of the second and fourth side wall.

5. The transmission/reception unit according to claim 1, wherein part of the third side wall located between the second and fourth corners is connected to the ground pattern, and wherein an electrical length of the ground conductor connected to the ground terminal of the antenna comprises:

a length of the ground pattern extending from the ground terminal to part of the third side wall;

a length from a point of connection with the ground pattern to a top of the third side wall;

a length on the top wall from the point of connection to one of the first and third corner; and a length from a top of one of the first, second and fourth side wall to a bottom of the one of the first, second and fourth side wall.

6. The transmission/reception unit according to claim 1, wherein part of the fourth side wall located between the third and fourth corners is connected to the ground pattern, and wherein an electrical length of the ground conductor connected to the ground terminal of the antenna comprises:

a length of the ground pattern extending from the ground terminal to part of the fourth side wall;

a length from a point of connection with the ground pattern to a top of the fourth side wall;

a length on the top wall from the point of connection to one of the first and second corner; and a length from a top of one of the first, second and third side wall to a bottom of the one of the first, second and third side wall.

7. The transmission/reception unit according to claim 1, wherein the antenna comprises a base made of an insulating material, an antenna element wound around an outer face of the base and transmission and reception terminals and a ground terminal which are provided on the outer face of the base, wherein with the antenna element lying over a notch made along the first side wall on the circuit board, both ends of the base rest on the circuit board while the transmission and reception terminals are connected to the wiring pattern, and wherein the ground terminal is connected to the ground pattern.

8. The transmission/reception unit according to claim 7, wherein the antenna has conductive connections which are connected with the transmission and reception terminals and the ground terminal, respectively, wherein the connections connected with the transmission and reception terminals are connected to the wiring pattern while the connection connected with the ground terminal is connected to the ground pattern and comprises part of an electrical length of the ground conductor.

9. The transmission/reception unit according to claim 7, wherein the base is made of ceramic.

* * * * *